US010760776B1

(12) United States Patent
Stange et al.

(10) Patent No.: US 10,760,776 B1
(45) Date of Patent: Sep. 1, 2020

(54) BAFFLE TRIM MASK SYSTEM

(71) Applicant: Broan-NuTone LLC, Hartford, WI (US)

(72) Inventors: Julie Stange, Hartford, WI (US); Eshank Singh, New Dehli (IN)

(73) Assignee: Broan-NuTone LLC, Hartford, WI (US)

( * ) Notice: Subject to any disclaimer, the term of this patent is extended or adjusted under 35 U.S.C. 154(b) by 0 days.

(21) Appl. No.: 16/274,365

(22) Filed: Feb. 13, 2019

(51) Int. Cl.
*F21V 17/16* (2006.01)
*F21V 17/00* (2006.01)
*F21S 8/02* (2006.01)

(52) U.S. Cl.
CPC ..... *F21V 17/164* (2013.01); *F21S 8/026* (2013.01); *F21V 17/002* (2013.01)

(58) Field of Classification Search
CPC ..... F21S 8/026; F21S 8/02; F21V 17/164; F21V 17/002; F21V 17/16
See application file for complete search history.

(56) References Cited

U.S. PATENT DOCUMENTS 4,475,147 A * 10/1984 Kristofek ..... F21S 8/026 362/147
6,364,511 B1 4/2002 Cohen
6,702,454 B2 3/2004 Grajetzky et al.
6,719,438 B2 4/2004 Sevack et al.
7,121,696 B2 10/2006 Whitfield, Sr.
7,399,104 B2 7/2008 Rappaport
8,096,686 B2 1/2012 Wilcox
8,182,116 B2 5/2012 Zhang et al.
8,403,541 B1 3/2013 Rashidi
8,454,204 B1 6/2013 Chang et al.
8,696,158 B2 4/2014 Santiago et al.
8,733,962 B1 5/2014 Leslie
9,039,254 B2 * 5/2015 Danesh ..... F21V 21/30 362/364
9,057,505 B2 6/2015 Liu et al.
9,404,639 B2 8/2016 Bailey et al.
9,506,611 B2 11/2016 Ramirez
9,557,021 B2 1/2017 Madden et al.
9,581,302 B2 2/2017 Danesh
9,618,195 B2 4/2017 Frank
9,803,814 B2 10/2017 Grant
9,903,569 B2 2/2018 Aaron
9,945,548 B2 4/2018 Williams et al.
9,964,266 B2 5/2018 Danesh
10,041,638 B2 8/2018 Vasquez et al.
10,041,654 B1 8/2018 Ernst et al.
(Continued)

FOREIGN PATENT DOCUMENTS

CA 2741071 C 4/2012
CA 2904954 A1 11/2013
(Continued)

*Primary Examiner* — William N Harris
(74) *Attorney, Agent, or Firm* — Barnes & Thornburg LLP

(57) ABSTRACT

A baffle system for a lighting or ventilation apparatus, the system having a baffle with a wall extending from an upper end to a lower end, and a lip extending from the wall lower end to a lip outer edge and defining a lip face. A mask is configured to couple to the baffle and cover the lip face. The mask provides aesthetics different from the aesthetics of the lip face and facilitates simple and economical alteration of the baffle aesthetics.

19 Claims, 11 Drawing Sheets

(56) References Cited

U.S. PATENT DOCUMENTS

| | | | | |
|---|---|---|---|---|
| 10,119,684 | B2 | 11/2018 | Aaron | |
| 10,139,060 | B1 | 11/2018 | Erdener et al. | |
| 10,619,808 | B2 * | 4/2020 | Serak | F21S 8/04 |
| 2011/0096554 | A1 * | 4/2011 | Jowid | F21S 8/02 362/351 |
| 2011/0116276 | A1 * | 5/2011 | Okamura | F21V 21/04 362/404 |
| 2013/0056142 | A1 | 3/2013 | Fiore et al. | |
| 2014/0063818 | A1 * | 3/2014 | Randolph | F21V 7/0091 362/311.02 |
| 2014/0104844 | A1 | 4/2014 | Fereydouny | |
| 2015/0362159 | A1 | 12/2015 | Ludyjan | |
| 2017/0191628 | A1 | 7/2017 | Nelkin et al. | |
| 2018/0231197 | A1 | 8/2018 | Danesh | |
| 2018/0347768 | A1 | 12/2018 | Vasquez et al. | |
| 2019/0101266 | A1 * | 4/2019 | Shah | F21V 17/16 |

FOREIGN PATENT DOCUMENTS

| | | | |
|---|---|---|---|
| CA | 2766601 | C | 7/2014 |
| CA | 2879629 | A1 | 8/2015 |
| CA | 2778581 | C | 12/2015 |
| CA | 2858753 | C | 12/2016 |
| CA | 2846521 | C | 10/2017 |
| CA | 2937197 | A1 | 12/2017 |

* cited by examiner

BAFFLE TRIM MASK SYSTEM

BACKGROUND

Field

The present disclosure generally relates to baffles for recessed lighting. The present disclosure more particularly relates to a mask for quickly and economically altering the aesthetic appearance of a baffle.

Related Prior Art

Conventional recessed lighting baffles provide a set aesthetic appearance from the moment the baffle is purchased from a retailor and installed within a structure. Changing the aesthetic appearance of a baffle typically requires changing the baffle. In some examples, changing a baffle requires the user to remove a light bulb and then either: i) remove internal springs that secure the baffle to an extent of the recessed light fixture or ii) pull down on the baffle to permit the user to remove torsion springs that are connected to the baffle from torsion spring bracket that is connected to the recessed light fixture. The performance of these steps can be challenging for an end user.

Additionally, removing and replacing the baffles may not be feasible because the user may not be able to purchase a baffle that fits the model of the recessed light fixture due to the fact that the manufacture stopped producing baffles for that specific product due to its age. In addition, removing and replacing the baffles may not be desired because the user may not be able to find a baffle with the desired aesthetic appearance. Further, the process of removing and replacing each and every baffle throughout a structure may be time consuming and expensive.

Moreover, offering a lighting or ventilating unit with baffles that have different aesthetics typically entails providing different products with different SKUs. Alternatively, offering a lighting or ventilating unit with baffles that have different aesthetics could be accomplished by offering the lighting or ventilating product without a baffle and separately offering a variety of baffles that have different aesthetics.

Therefore, a need exists for an improved system for providing lighting or ventilating systems with baffles of different aesthetics and which allows users to easily and economically update the aesthetic appearance of a baffle after it is installed within a structure.

The description provided in the background section should not be assumed to be prior art merely because it is mentioned in or associated with the background section. The background section may include information that describes one or more aspects of the subject technology.

SUMMARY

A lighting system is disclosed comprising a baffle having a wall extending from an upper end to a lower end, and a lip extending from the wall lower end to a lip outer edge and defining a lip face; a mask configured to couple to the baffle and cover the lip face; and wherein the mask provides aesthetics different from the aesthetics of the lip face. The wall can be annular and the wall upper end of the wall can define an aperture. The wall can be annular and convex between the wall upper end and the wall lower end. The mask can comprise an outer flange defining an outer edge and an inner end; at least one finger extending from the outer flange outer edge; and an inner flange extending from the outer flange inner end. Each of the at least one mask fingers can be configured to engage the baffle lip outer edge and the mask inner flange can be configured to engage the baffle wall adjacent the wall lower end. The mask can comprise an outer flange defining an outer edge and an inner end; an inner flange extending from the outer flange inner end; and at least one rib extending from the inner flange. Each of the at least one ribs can be configured to engage the baffle wall adjacent the wall lower end to create a force fit of the mask to the baffle. Each of the at least one ribs can be configured to engage a receptacle defined in the baffle wall to hold the mask to the baffle. The lighting system can be configured to move air from the baffle wall lower end to the baffle wall upper end.

A mask is disclosed and is configured to couple to a lighting baffle comprising a wall extending from an upper end to a lower end and a lip extending from the wall lower end to a lip outer edge and defining a lip face, the mask comprising an outer flange defining an outer edge and an inner end and having aesthetics different from the aesthetics of the lip face; and an inner flange extending from the outer flange inner end, wherein the mask is configured to couple to the baffle and cover the lip face. The mask can comprise at least one finger extending from the outer flange outer edge. The at least one mask finger can be configured to engage the baffle lip outer edge and the mask inner flange can be configured to engage the baffle wall adjacent the wall lower end. The inner flange can be configured to create a force fit against the baffle to couple the mask to the baffle. The mask can comprise one of a rib or a nub on the inner flange to couple the mask to the baffle.

A baffle kit is disclosed comprising a lighting baffle having a wall extending from an upper end to a lower end and a lip extending from the wall lower end to a lip outer edge and defining a lip face, a first mask configured to couple to the baffle and cover the lip face, wherein the first mask provides aesthetics different from the aesthetics of the lip face; and a second mask configured to couple to the baffle and cover the lip face, wherein the second mask provides aesthetics different from the aesthetics of the lip face and the first mask. Only portions of the first mask need provide aesthetics different from the aesthetics of the lip face. The mask can comprise an outer flange defining an outer edge and an inner end; an inner flange extending from the outer flange inner end; and only portions of the outer flange need provide aesthetics different from the aesthetics of the lip face. The mask can comprise an outer flange defining an outer edge and an inner end; an inner flange extending from the outer flange inner end; and at least one finger extending from the outer flange outer edge. The mask can comprise an outer flange defining an outer edge and an inner end; an inner flange extending from the outer flange inner end; and the inner flange can be configured to create a force fit against the baffle. The baffle can be configured to permit movement of air from the baffle wall lower end to the baffle wall upper end.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

Figure 1:
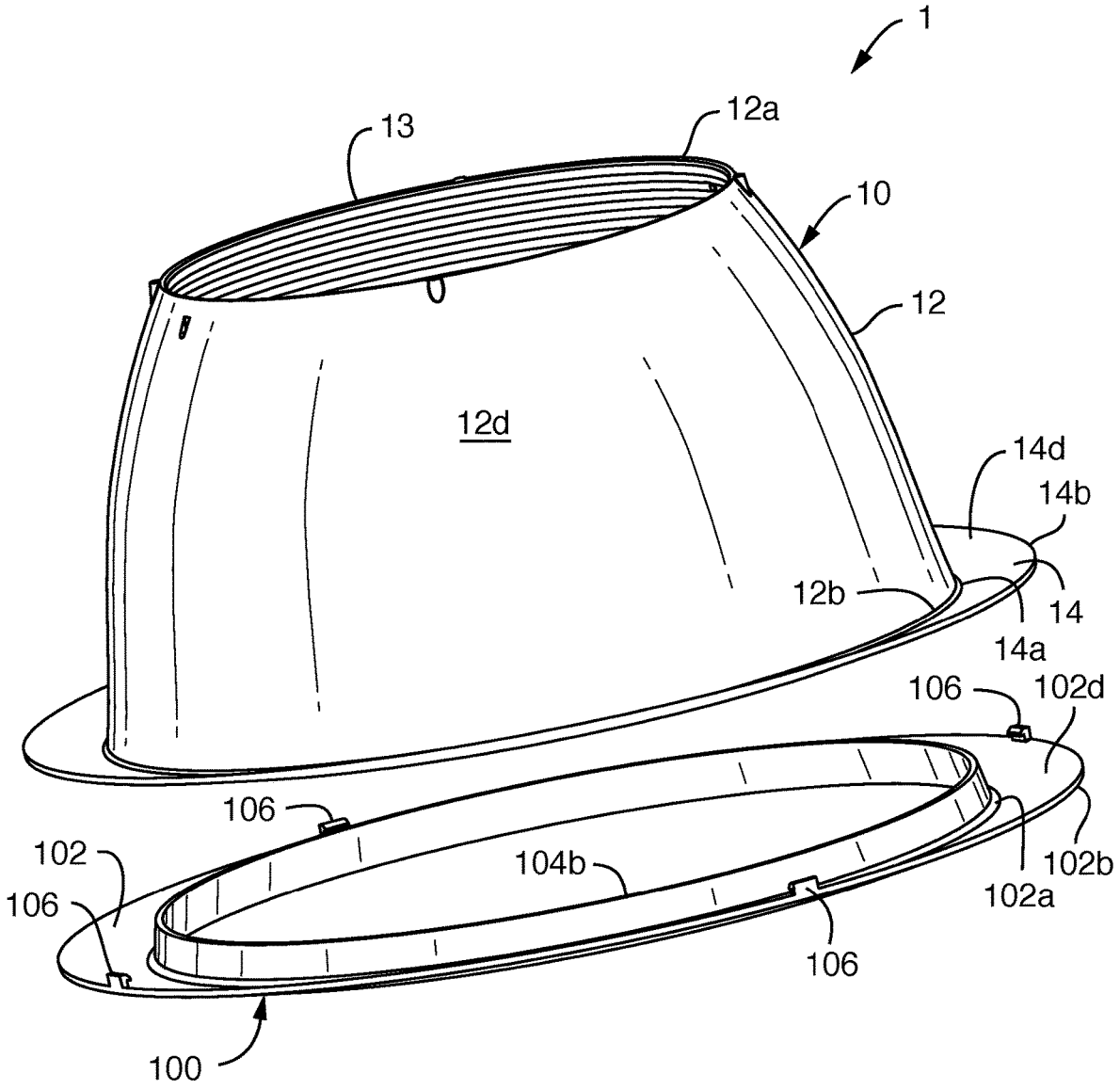
FIG. 1 is a top perspective exploded view of an exemplary embodiment of a baffle and mask system in accordance with the disclosure.
Figure 2:
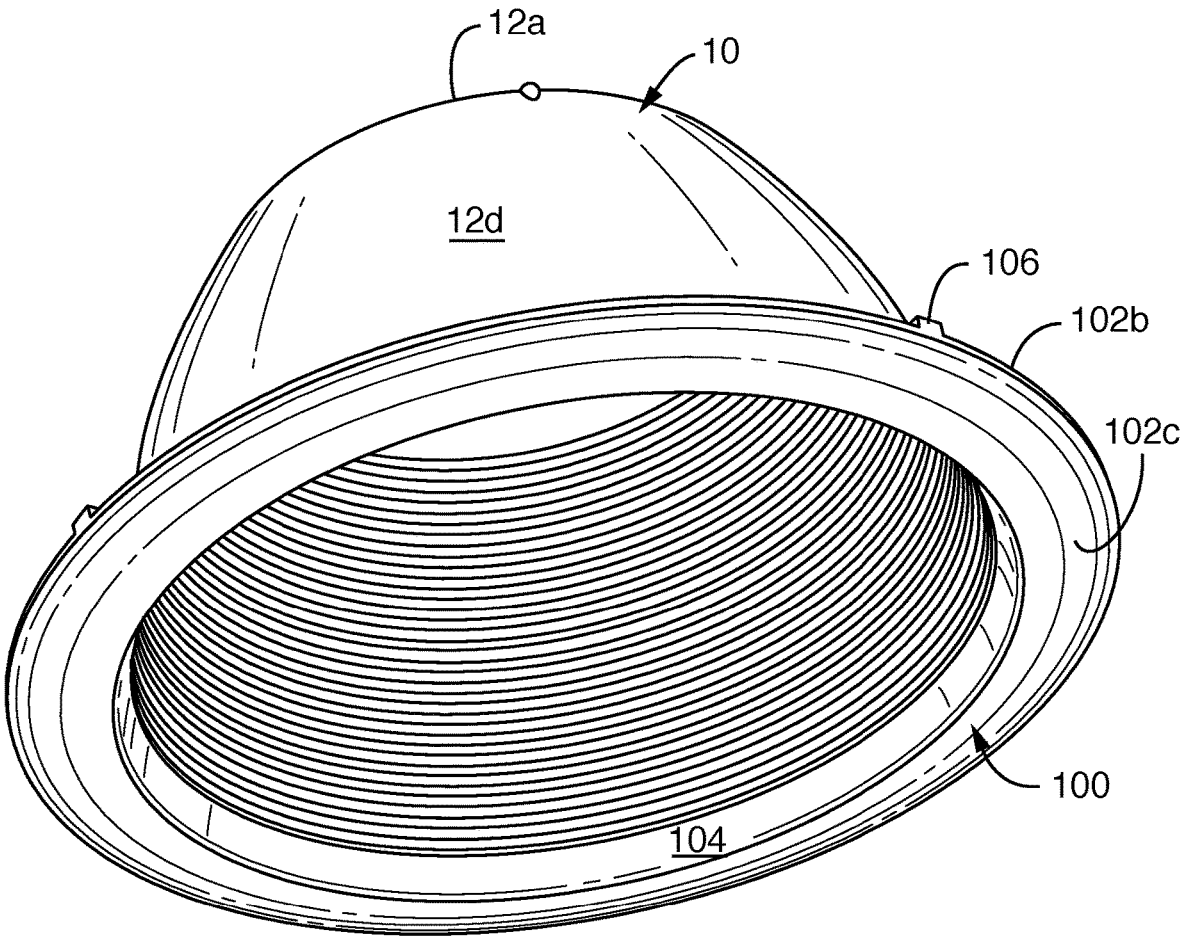
FIG. 2 is a bottom perspective view of the system of FIG. 1.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

Referring now to the drawings, one exemplary baffle system 1 is depicted in FIGS. 1-4 for use with a lighting fixture. Exemplary alternative embodiments are depicted in FIGS. 5-8. In some instances, the lighting fixture is a portion of a ventilation system such as the lighting and ventilating systems disclosed in the following U.S. Patent Numbers all of which are incorporated herein by reference: U.S. Pat. Nos. 7,175,309; 7,455,432; 8,434,916. In other instances, the lighting fixture is not a portion of a ventilation system.

FIGS. 1-4 depict an exemplary baffle system 1 comprising a baffle 10 and a mask 100 configured to be coupled to the baffle 10. The baffle 10 can be a pre-existing baffle to which the mask 100 is retrofit, or the baffle 10 and the mask 100 can be provided together. The baffle 10 can be provided with a plurality of masks 100 with different aesthetics to provide choice among the different aesthetics of the plurality of masks 100 to be applied to the baffle 10.

As depicted in various of the FIGS. 1-4, the baffle 10 comprises a wall 12 extending from an upper end 12*a* to a lower end 12*b*. The wall 12 extends about an area in which a lighting element (not depicted) would be located. The wall upper end 12*a* defines an upper aperture 13 through which the lighting element may extend into a socket (not depicted). The wall lower end 12*b* defines a lower aperture 15. A lighting element may be engaged with or disengaged from a socket through the upper and lower apertures 13, 15. When the baffle system 1 is a portion of a ventilation system, the upper and lower apertures 13, 15 can also permit movement of air through the baffle 10. The wall 12 can extend about the area in which a lighting element would be located in a circular manner defining annular upper and lower apertures 13, 15. The wall 12 can alternatively extend in other manners to form upper and lower apertures 13, 15 that have different shapes. For example, the shape of the upper and lower apertures 13, 15 can include an oval, a rectangle, a square or any other polygon.

Figure 3:
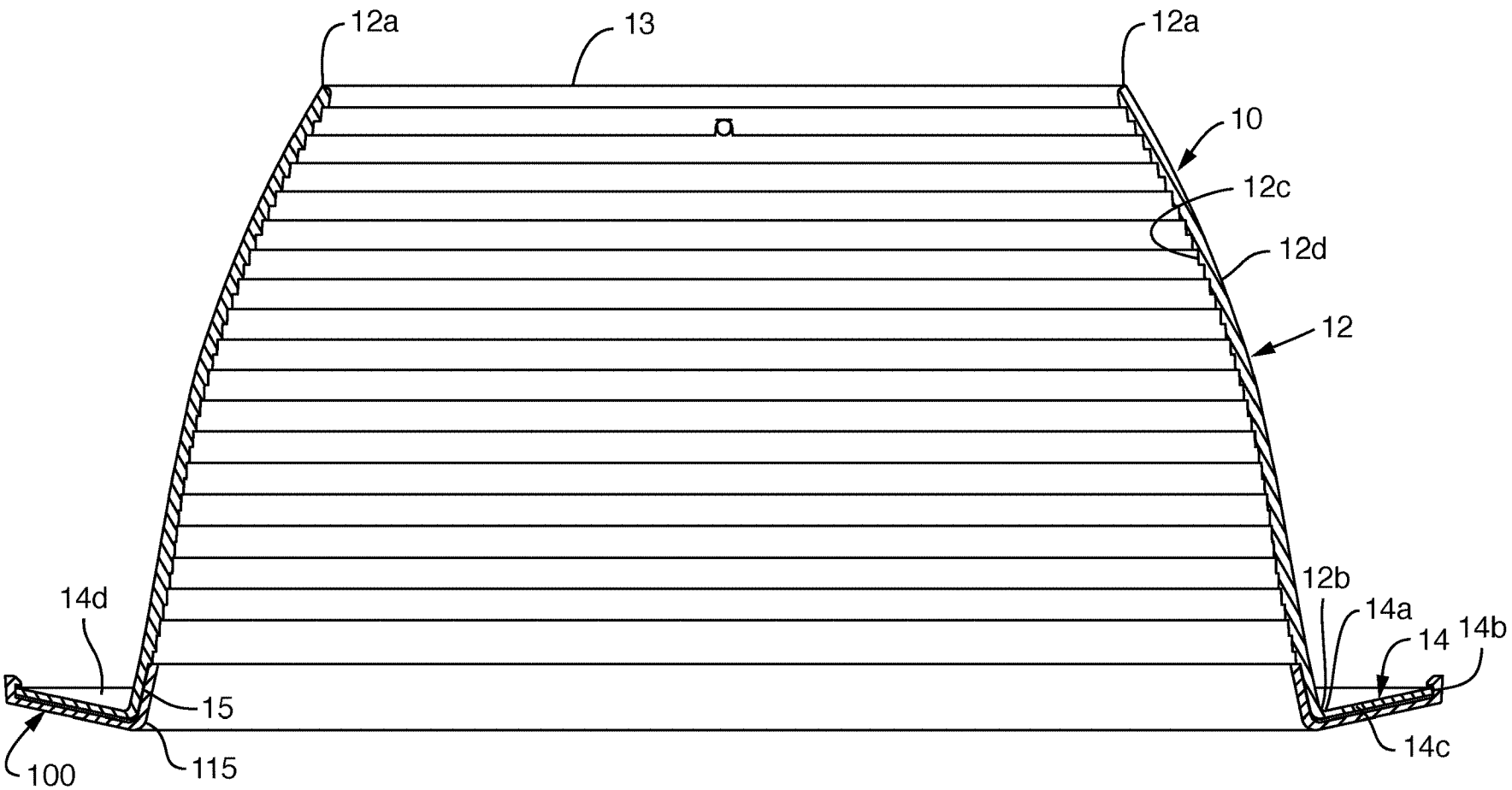
FIG. 3 is a cross-sectional view of the system of FIG. 1.

As best depicted in FIG. 3, the wall 12 can extend from the upper end 12*a* to the lower end 12*b* to define a cone such that the upper aperture 13 is smaller than the lower aperture 15. In the depicted embodiment of FIG. 3, the wall is also convex between the upper end 12*a* and the lower end 12*b*, forming a truncated convex cone. Other shapes and configurations of the baffle wall 12 are also contemplated. For example, the upper and lower apertures 13, 15 can be of any relative size to each other and the wall can extend from the upper end 12*a* to the lower end 12*b* in a straight or concave manner.

The wall 12 defines an inner surface 12*c* and an outer surface 12*d*. The inner surface 12*c* is configured to act as a reflector for the light emitted by the lighting element inserted therein. In the embodiment depicted in FIGS. 1-4, the inner surface 12*c* is a stepped configuration. The inner surface 12*c* can be of any color or configuration, or comprise any coating (e.g., metallic) to facilitate the desired reflective characteristics and aesthetic appearance.

A lip 14 extends from the wall lower end 12*b* outward in a substantially radial manner from a lip inner end 14*a* to a lip outer edge 14*b*. The lip 14 is depicted as angled slightly upward from radial toward the wall upper end 12*a*. Various lip angles are within the scope of this disclosure. The lip 14 defines a lip face 14*c* and an opposing lip rear 14*d*. The lip 14 defines a height at its outer edge 14*b*.

Upon installation of the baffle 10 in a ceiling, the lip 14 is intended to cover and hide any gap between the wall 12 and the hole cut in the ceiling to accommodate the baffle 10. The length of the lip 14 between the inner end 14*a* and the outer edge 14*b* should be sufficient to cover any such gap. The lip rear 14*d* would face the adjacent ceiling and any gaps between the wall 12 and the ceiling. The lip rear 14*b* would therefore be hidden from sight after installation. However, the lip face 14*c* would face outward and exposed to view, unless and until covered by the mask 100. The lip face 14*c* can therefore be of any aesthetic appearance desired, including, but not limited to, the color, configuration, or coating of the wall inner surface 12*c*. In one configuration, the lip face 14*c* can be of a standard color and configuration desired by the largest number of consumers so as to allow the majority of consumers to obtain their desired aesthetics with the lip face 14*c* without need for the mask 100.

The mask 100 provides a structure, which facilitates a quick, easy and inexpensive change of the aesthetics of the lip face 14*c*. The mask 100 covers a lip face 14*c* to hide its aesthetics and replaces those aesthetics with those of the mask 100. The mask 100 can be applied to a pre-existing baffle 10 to hide and change the aesthetics of the lip face 14*c* of that pre-existing baffle 10. For example, upon upgrading various aspects of the decor of a surrounding room, a user might which to alter the aesthetics of the lip face 14*c* of that pre-existing baffle 10 accordingly. For example, the aesthetics of the mask 100 could be chosen to match or contrast the aesthetics of the upgraded decor depending on the taste of the consumer.

Alternatively, a kit can be provided to consumers comprising a baffle 10 with a first mask 100 and second mask 100' of different aesthetics than the first mask 100 and the lip face 14*c* of the baffle 10. Additional masks of different aesthetics than any other mask or the baffle lip face can also be provided. The kit then affords a consumer the opportunity to install the baffle 10 alone or with any one of the various masks 100, thus allowing the consumer to choose an aesthetic without the need of providing the consumer more than one baffle 10. This results in savings associated with providing more than one baffle to the consumer and the costs of shipping multiple baffles. Another benefit of the disclosed system is that a user can create a light fixture with a unique appearance, wherein the lip face 14*c* of the baffle 10 is different than the appearance of the inner surface 12*c* of the baffle 10. This enables the user to keep the desired reflective properties of the inner surface 12*c* of the baffle 10, while changing the appearance of the baffle 10 that is most prominent to the user's view.

Figure 4:
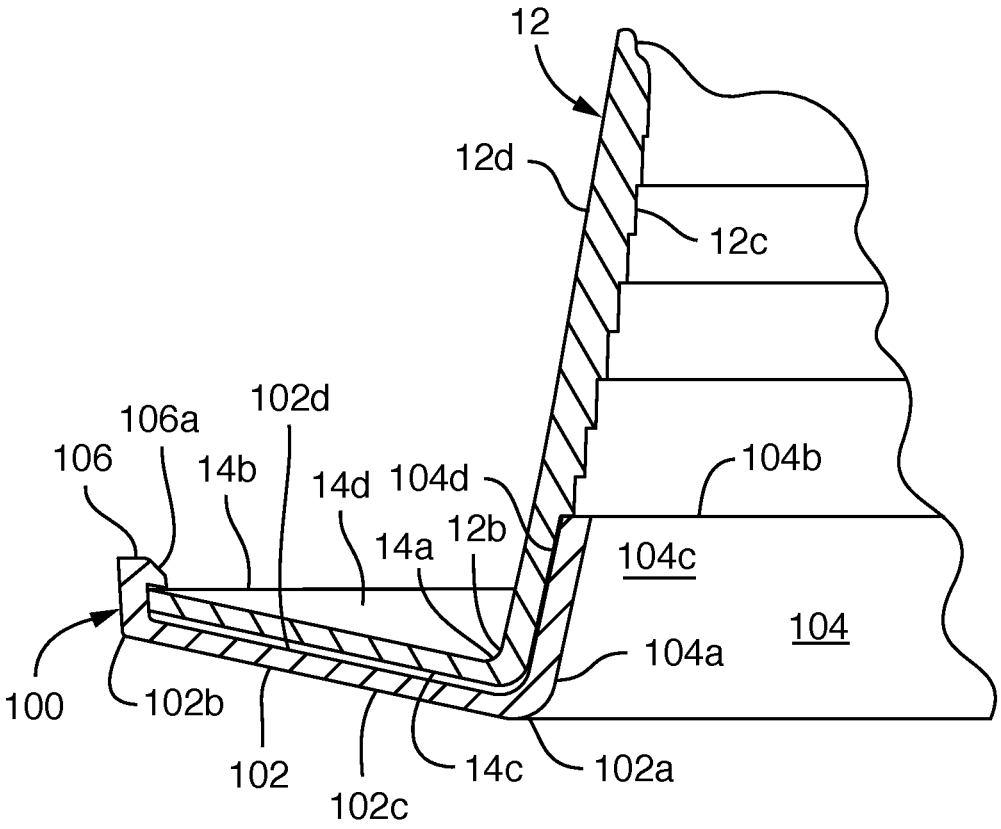
FIG. 4 is an outtake of a portion of the view of FIG. 3.
Figure 5:
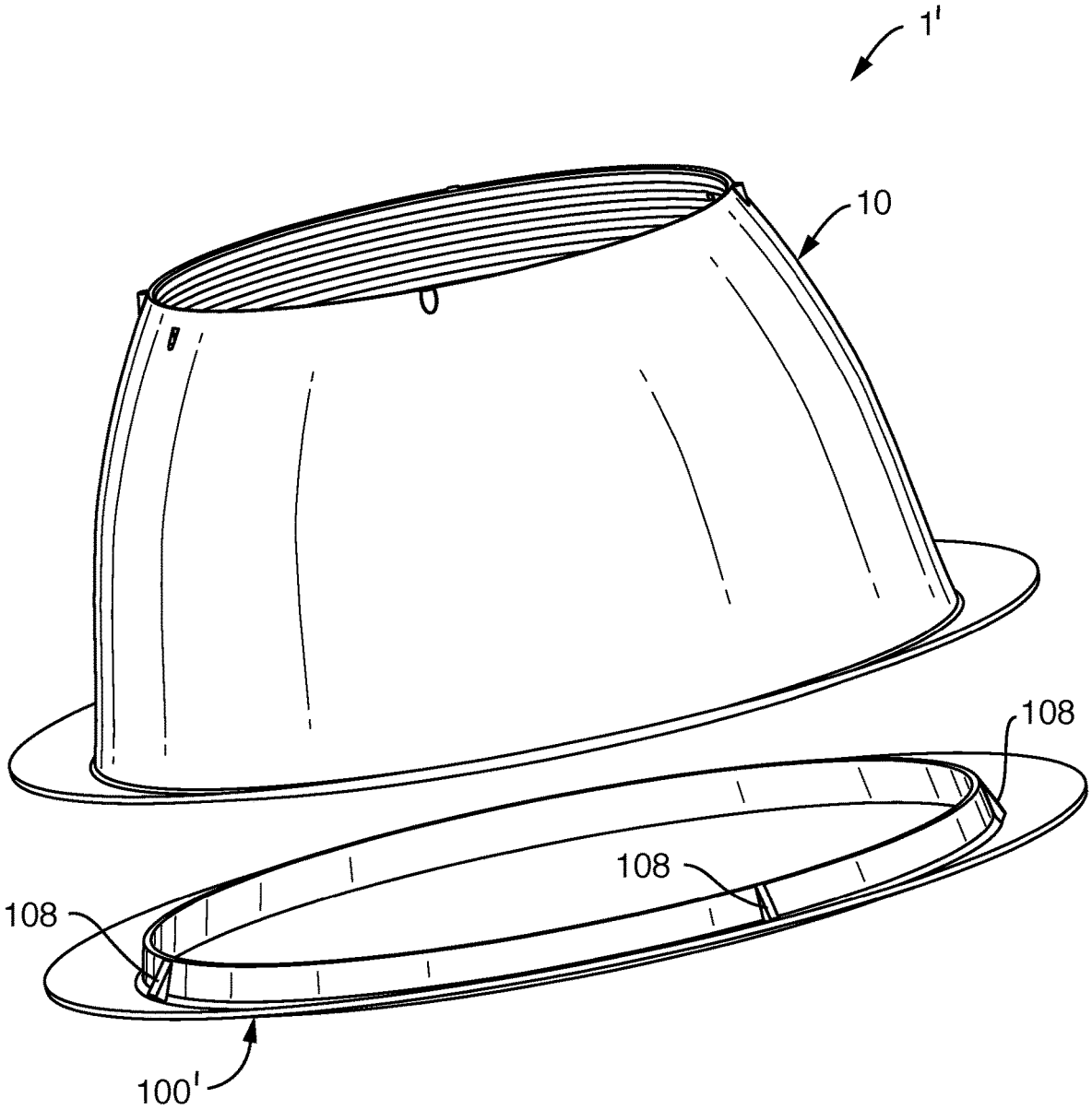
FIG. 5 is a top perspective exploded view of an alternative embodiment of a baffle and mask system in accordance with the disclosure.
Figure 6:
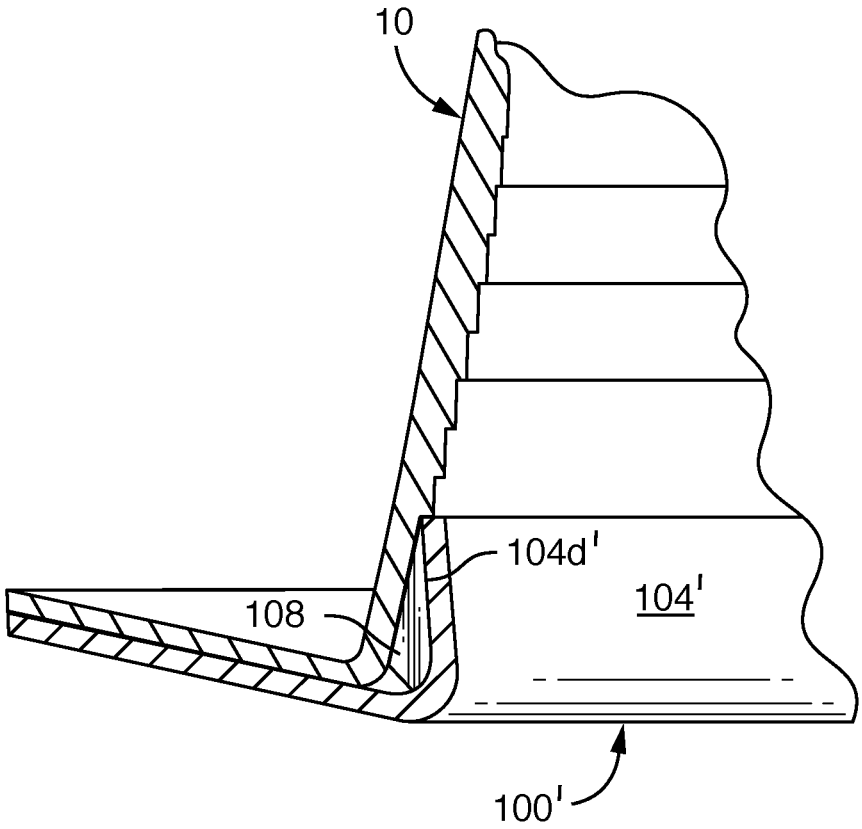
FIG. 6 is a cross-sectional view of a portion of the system of FIG. 5.
Figure 7:
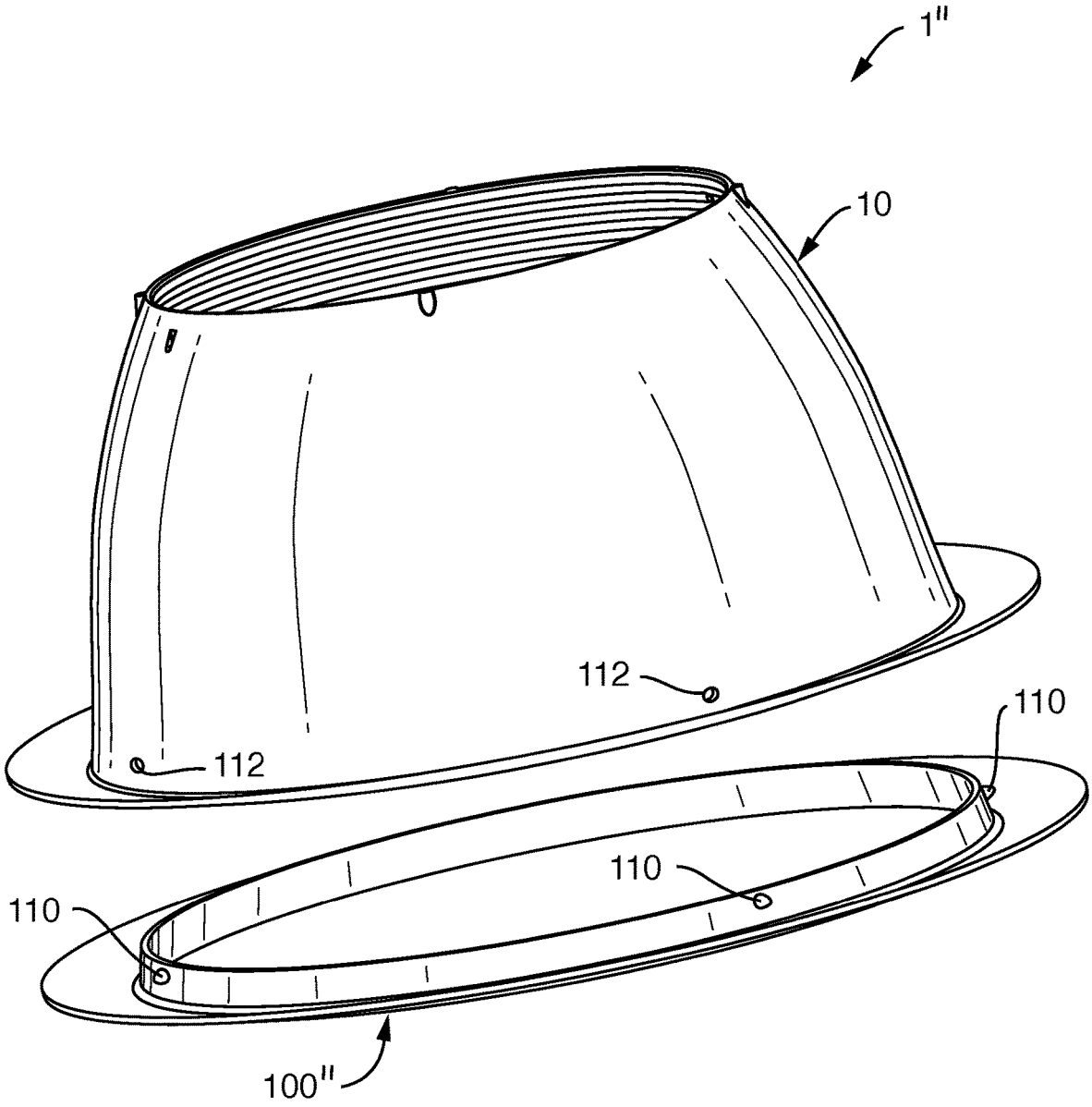
FIG. 7 is a top perspective exploded view of another alternative embodiment of a baffle and mask system in accordance with the disclosure.
Figure 8:
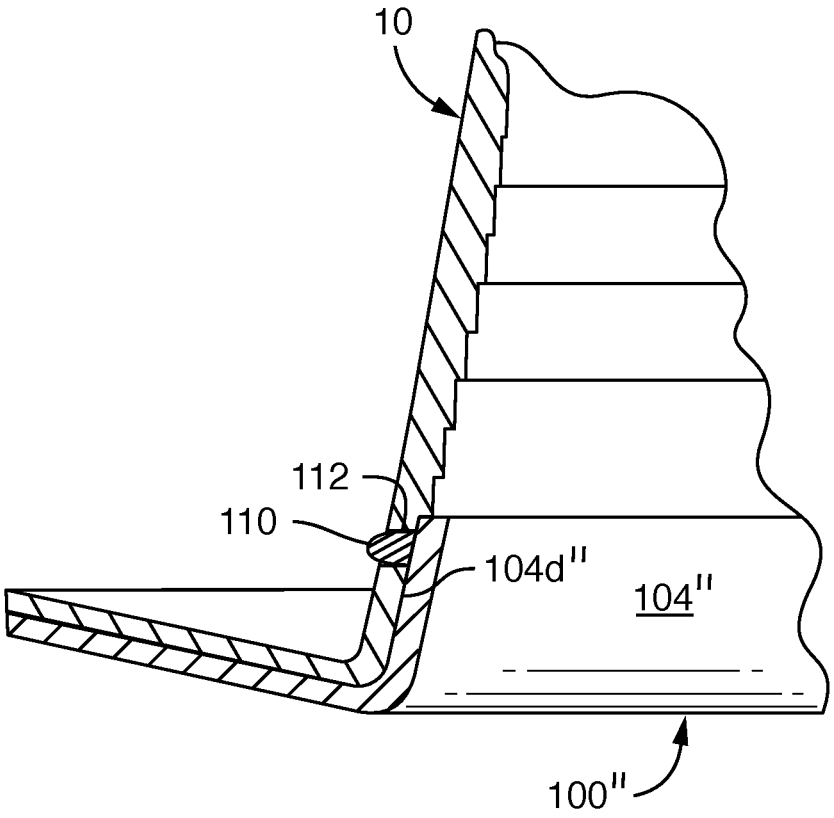
FIG. 8 is a cross-sectional view of a portion of the system of FIG. 7.

The mask 100 of this disclosure can be accomplished in various configurations. Three different configurations are depicted in the figures. FIGS. 1-4 depict a first embodiment of the mask 100. FIGS. 5-6 depict a second embodiment of the mask 100' in which like reference numerals as used as the first embodiment for like elements with an ' added. FIGS. 7-8 depict a third embodiment of the mask 100" in which like reference numerals as used as the first embodiment for like elements with an " added. Other configurations are also contemplated and will be understood by those of ordinary skill in the art.

The mask 100 of the embodiment depicted in FIGS. 1-4 comprises an outer flange 102 having an inner end 102*a* and an outer edge 102*b* and defining an outer flange face 102*c* and an outer flange inner surface 102*d*. The mask 100 also comprises an inner flange 104 extending from the outer flange inner end 102*a* and upward into the corresponding baffle 10. The outer flange outer edge 102*b* defines the outer perimeter of the mask 100 and a plurality of fingers 106 extend from the outer edge 102*b*. The embodiment of FIGS. 1-4 comprises four fingers 106 spaced equidistant from one another about the outer flange outer edge 102*b*. Fewer or greater fingers 106 and/or different spacing of the fingers are also within the scope of this disclosure. For example, the fingers 106 may completely surround the outer flange outer edge 102*b*.

The fingers 106 each comprise a catch 106*a* that extends inward and towards the inner end 102*a* of the outer flange 102. These fingers 106 are configured and designed to facilitate the coupling of the mask 100 to the baffle 10. Specifically, to couple the mask 100 to the baffle 10, a user applies an upwardly directed force on the mask 100. This upwardly directed force causes the fingers 106 to temporarily deform/flex outward away from the inner end 102*a* of the outer flange 102. The user will continue to apply the upwardly directed force on the mask 100 until the bottom edge of the catch 106*a* passes the lip rear 14*d* at which point the catch 106*a* will return and/or snaps back to its undeformed position. When the catch 106*a* returns and/or snaps back into this undeformed position, an audible sound or click may be heard by the user signaling that the mask 100 is coupled to the baffle 10. After the finger has returned to its undeformed position, as depicted in FIG. 4, the finger 106 will extend along the height of the baffle lip outer edge 14*b*. The catch 106*a* will extend inward from the finger 106 over the lip rear 14*d*.

As shown in FIG. 4, an extent of the catch 106*a* extends past the outer edge 14*b* of the lip 14 and over a portion of the lip 14. It should be understood that extent of the catch 106*a* that extends past the outer edge 14*b* in the connected position may vary from 0.05 inch to 0.25 inch. While not shown, it should be understood that when the mask 100 is coupled to the baffle 10, the catch 106*a* is in close proximity (e.g., less than 0.5 inch) or in some installations in direct contact with the bottom surface of the ceiling of the structure. This configuration ensures that the user cannot see a substantial gap (e.g., more than 1 inch) between the ceiling of the structure and the baffle 10 and mask 100 combination, which helps ensure that the user cannot see the recessed lighting fixture. In other words, the mask 100 does not hang down from the lip 14 of the baffle 10 in a manner that forms a substantial gap (e.g., more than one inch) between the mask 100 and the lip face 14*c*.

In some embodiments, the baffle 10 may include notches (not depicted) are formed within the lip rear 14*d* or at the lip outer edge 14*b*. These notches may be configured to ease or guide the fingers 106 into place. As indicated above, the number of fingers 106 can vary so long as the purpose of coupling the mask 100 to the baffle 10.

The mask inner flange 104 is configured to accommodate and conform to the baffle wall inner surface 12*c* adjacent to the wall lower end 12*b* so as to provide an accommodating fit and, preferably, leave minimal transition between the inner flange 104 and the baffle wall 12 such as by tapering the inner flange from a lower end 104*a* toward an upper end 104*b*. In the disclosed embodiments, the inner flange 104 extends upward into the baffle 10 until the first step in the inner surface's 12*c* stepped configuration. It should be understood that the inner flange 104 may extend: i) the entire length of the wall 12, ii) a length that is greater than half of the entire length of the wall 12, iii) a length that is greater than a plurality of steps, iv) a length that is between the length of the inner flange 104 shown in FIG. 4 and the length of the finger 106 or v) a length that is less than the length of the finger 106.

As shown in FIG. 4, the mask inner flange 104 can be configured to create a force fit of the inner face 104*d* of the mask inner flange 104 against the baffle wall 12 such as by configuring the angle between the mask inner flange 104 and the fingers 106 to be less than the angle between the baffle wall 12 and the baffle lip 14. In an alternative embodiment, the force fit between the mask inner flange 104 and the baffle wall 12 could alone be sufficient to couple the mask 100 to the baffle 10 and the fingers 106 could be removed.

In addition to the above requirements, the mask is generally configured to nest with the baffle lip 14 and cover the baffle lip 14 to allow the aesthetics of the mask outer flange face 102*c* to replace the aesthetics of the baffle lip 14. When the mask 100 is coupled to the baffle 10, the mask inner flange will define a system lower aperture 115 through which any inflowing air would pass.

The mask 100 can provide new aesthetics to the baffle 10 by way of being a different color and/or have a different surface texture and/or have a different surface coating. Any manner of different aesthetic is within the scope of this disclosure. For example, the mask 100 may be designed to match patterned wallpaper, Venetian plaster, other types of faux finishes, custom ordered paint colors, concrete (e.g., colored or non-colored), wood, brick, stone, metal, or other types of finishes that may be used on an interior wall of a structure. To create these various finishes, the mask 100 may be formed (e.g., injection molded) and then a label (e.g. label 200 or label 300) or coating may be applied to all or any portion of the mask outer flange face 102*c* and/or the mask inner flange inner face 104*c*. Alternatively, a label or coating may be applied to the mask 100 during the formation (e.g., molding of the mask 100). This alternative method of manufacturing the mask 100 utilizes a molding process known as in-mold labeling in which the label is integrally formed as a part of the mask 100. It should be understood that other manufacturing techniques are contemplated by this disclosure, including in-mold decoration, gas assisted injection molding, inkjet printing, in-mold coating, in-mold film processing, pad printing, vacuum deposition of materials onto the mask 100, or other types of additive manufacturing.

The system 1' of FIGS. 5-6 is similar to the system 1 of FIGS. 1-4 and provides a different configuration mask 10' to couple to the same baffle 10. The mask 10' of the system 1' provides a plurality of ribs 108 extending from outer face 104*d*' of the mask inner flange 104'. The ribs 108 increase the force fit between the mask inner flange 104' and the baffle 10. The ribs 108 can be of any configuration to facilitate the increased force fit.

The system 1" of FIGS. 7-8 is similar to the system 1 of FIGS. 1-4 and provides a different configuration mask 10". The mask 10" of the system 1" provides a plurality of nubs 110 extending from outer face 104*d*" of the mask inner flange 104". The nubs 110 can act to increase the force fit between the mask 100" and the baffle 10. Alternatively, the nubs 110 can be received into a corresponding plurality of receptacles 112 in the baffle 10. The receptacles 112 can be pre-existing or formed at the time of installation. The receptacles 112 are depicted as a through-hole in the baffle wall 12, but could also be an indent in the wall inner face 12*c*.

Figure 9:
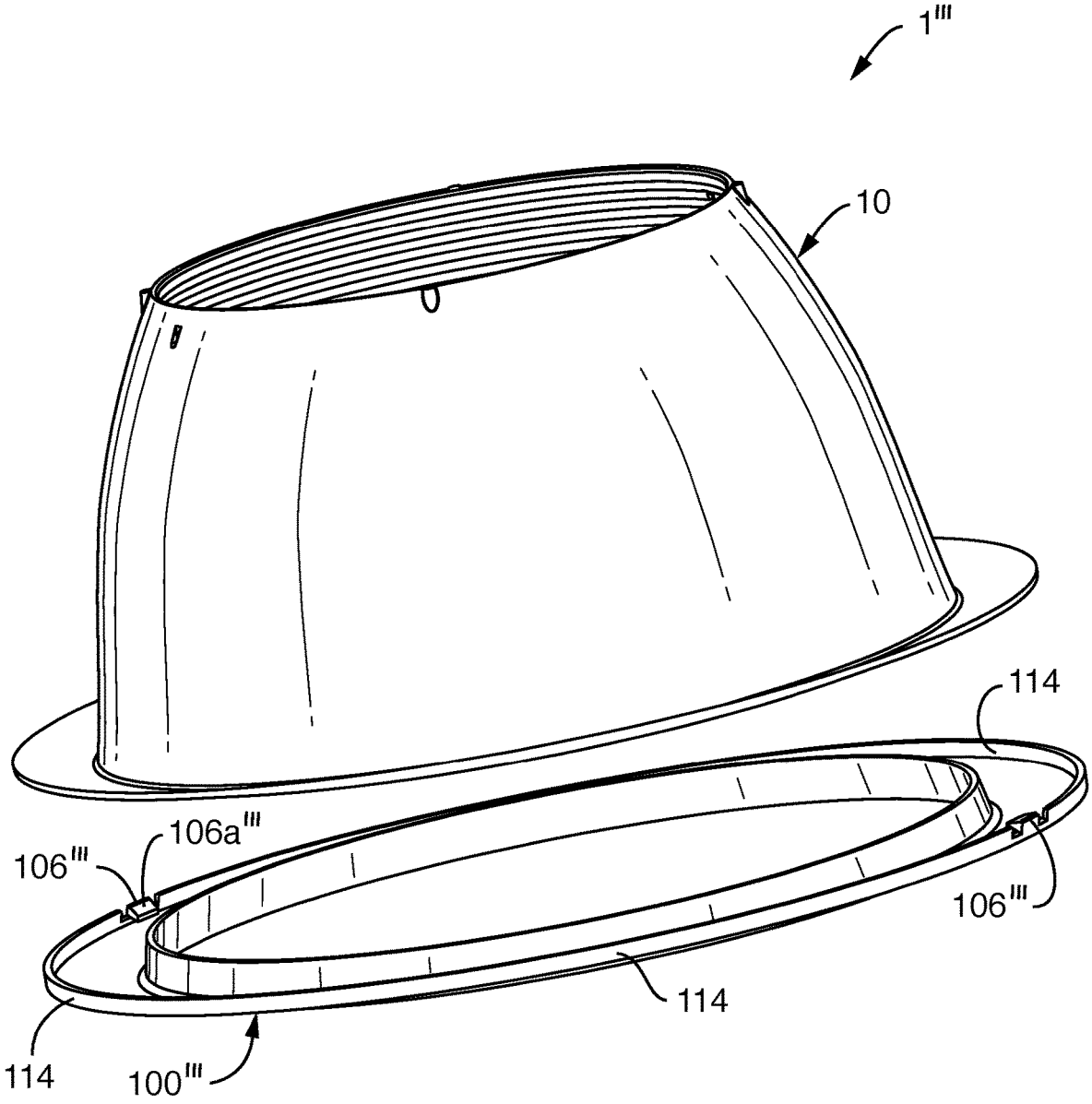
FIG. 9 is a top perspective exploded view of an additional alternative embodiment of a baffle and mask system in accordance with the disclosure.
Figure 10:
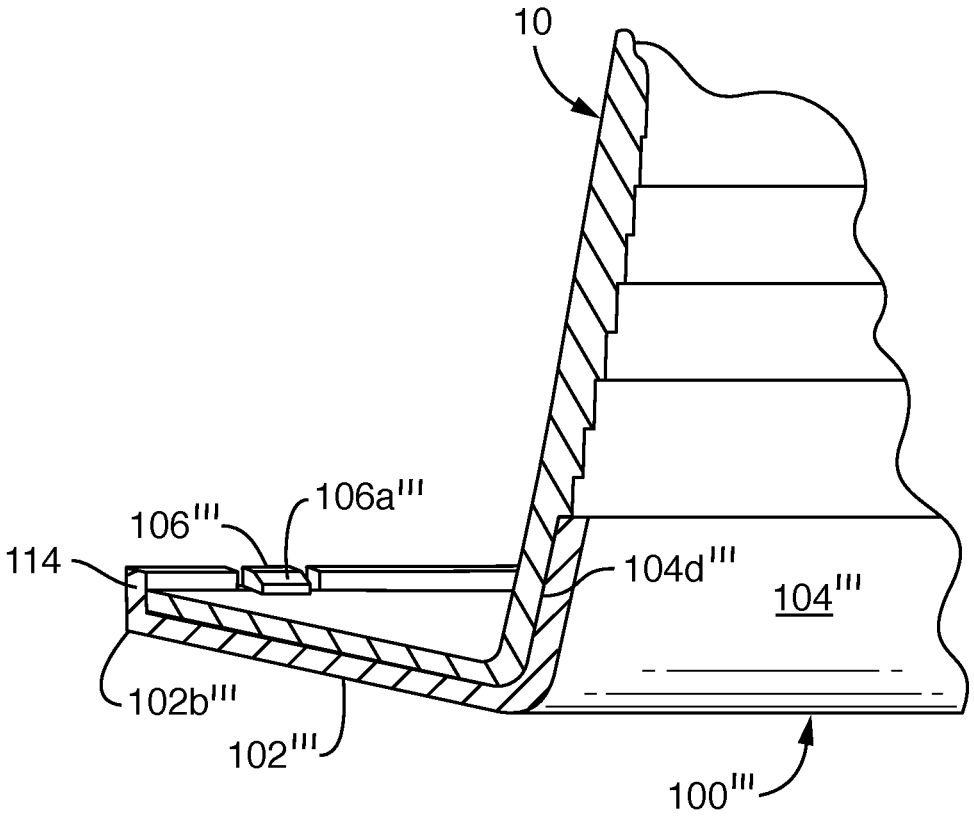
FIG. 10 is a cross-sectional view of a portion of the system of FIG. 9.
Figure 11A:
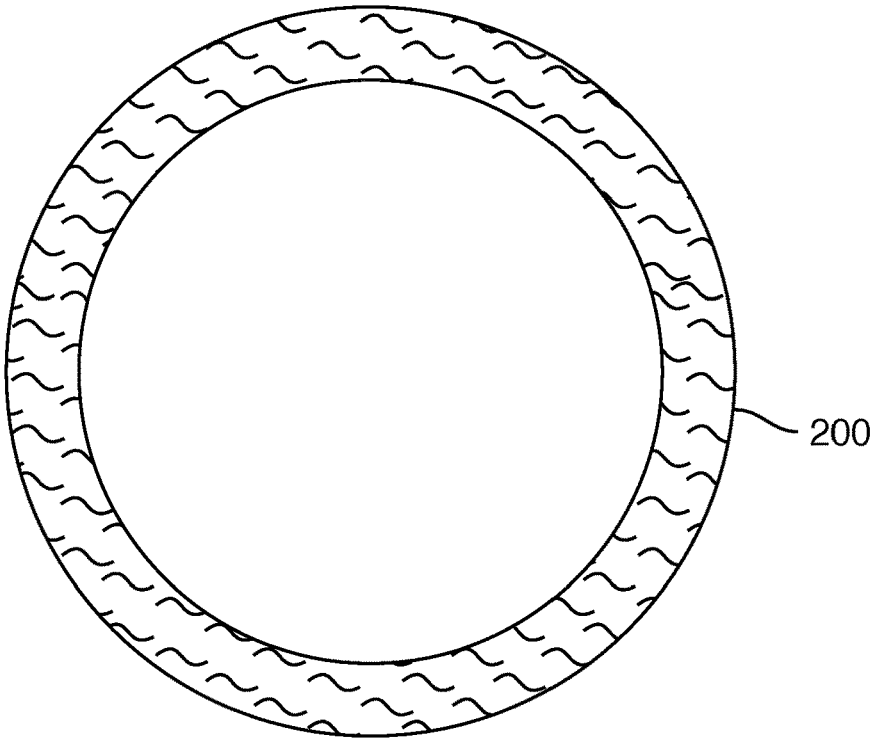
FIG. 11A a bottom elevational view of a first label for the mask outer flange face.
Figure 11B:
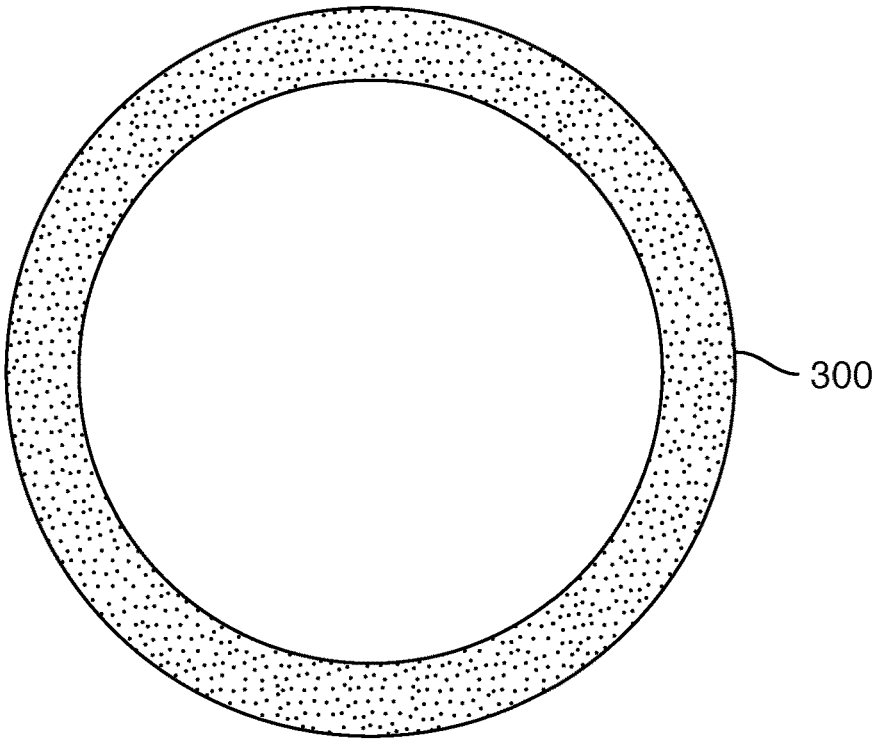
FIG. 11B a bottom elevational view of a second label for the mask outer flange face.

The system 1''' of FIGS. 9-10 is similar to the system 1 of FIGS. 1-4 and provides a different configuration mask 100'''. The mask 100''' of the system 1''' provides a plurality of fingers 106''' extending upward from outer edge 102*b*''' of the mask outer flange 102'''. Each finger 106''' includes a catch 106*a*''' is located at the distal end of the finger and is configured similar to the configuration of catch 106*a* in the system 1 of FIG. 104 and sized to allow the mask 100''' to be placed over the lip outer edge 14*b* of the baffle 10 such that the finger catches 106*a*''' snap over the lip outer edge 14*b* to retain the mask 100''' to the baffle 10. Unlike the mask 100 of FIGS. 1-4, the mask 100''' depicted in FIGS. 9-10 also includes a peripheral wall 114 extending upward from the outer edge 102*b*''' of the mask outer flange 102''' to substantially the same height as the fingers 106''' and extends around substantially the entire perimeter of the mask outer flange 102''' between the fingers 106'''. The distal end of the peripheral wall 114 is thus configured to come into contact with a ceiling in which the baffle 10 is installed. In this configuration, the peripheral wall 114 hides the outer edge 14*b* of the baffle lip 14. Although two fingers 106''' are depicted in FIGS. 9-10, any other number of fingers 106''' is contemplated as within this disclosure. Additionally, depending on the rigidity of the material from which the mask 100''' is comprised, one or more slots (not depicted) in the peripheral wall 114 at locations between the finger 106''' may be defined in order to provide additional flexibility to the mask 100''' to assist in the finger catches 106*a*''' moving around the lip outer edge 14*b* during installation or removal.

While preferred embodiments have been described above and illustrated in the accompanying drawings, it will be evident to those skilled in the art that modifications may be made without departing from this disclosure. Such modifications are considered as possible variants comprised in the scope of the disclosure. For example, such modifications to the disclosed embodiments include altering the size or shape of the mask outer flange 102. Specifically, the mask outer flange 102 may extend between 0.2 and 3 inch past the outer edge 14*b* of the baffle 10. This configuration allows the mask 100 to cover any openings in the ceiling that the baffle 10 was not able to cover. Alternatively, the mask 100 may have a shape that is different from the shape of the baffle 10. For example, the baffle 10 may have annular upper and lower apertures 13, 15, while the shape formed by the inner and outer edges 102*a*, 102*b* may be a square. In another example, the baffle 10 may have annular upper and lower apertures 13, 15, while the shape formed by the outer edge 102*b* may be a square and the shape formed by the inner edge 102*a* may match the lower aperture 15.

In addition, modifications to the disclosed embodiments include the addition of diffusers or other types of optics that are positioned between the inner edge 102*a* of the mask 100. These diffusers or optics alter or change the light that is emitted by the light bulb when the light passes through these substances. It should be understood that if a diffuser or another type of optic were utilized in connection with the mask 100 and a ventilation product, then the diffuser or optic would need to be able to allow a sufficient amount of air pass through the diffuser or optic to enable the ventilation product to properly function.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. In addition, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

In one aspect, a term coupled or the like may refer to being directly coupled. In another aspect, a term coupled or the like may refer to being indirectly coupled. Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The use of the terms "a" and "an" and "the" and "said" and similar references in the context of describing the invention (especially in the context of the following claims) are to be construed to cover both the singular and the plural, unless otherwise indicated herein or clearly contradicted by context. An element proceeded by "a," "an," "the," or "said" does not, without further constraints, preclude the existence of additional same elements. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

What is claimed is:

1. A lighting system comprising:

a baffle having a wall extending from an upper end to a lower end, and a lip extending from the wall lower end to a lip outer edge and defining a lip face; and a mask configured to couple to the baffle and cover the lip face, the mask comprising an outer flange defining an outer edge and an inner end; and at least one finger extending from the outer flange outer edge, the finger configured to extend along a height of the baffle lip outer edge to couple the mask to the baffle;

wherein the mask provides aesthetics different from aesthetics of the lip face.

2. The lighting system of claim 1 wherein the wall is annular and the upper end of the wall defines an aperture.

3. The lighting system of claim 1 wherein the wall is annular and is convex between the wall upper end and the wall lower end.

4. The lighting system of claim 1 the mask further comprising an inner flange extending from the outer flange inner end.

5. The lighting system of claim 4, wherein each of the at least one mask fingers is configured to engage the baffle lip outer edge and the mask inner flange is configured to engage the baffle wall adjacent the wall lower end.

6. The lighting system of claim 1 the mask further comprising:

an inner flange extending from the outer flange inner end; and at least one rib extending from the inner flange.

7. The lighting system of claim 6, wherein each of the at least one ribs is configured to engage the baffle wall adjacent the wall lower end to create a force fit of the mask to the baffle.

8. The lighting system of claim 6, wherein each of the at least one ribs is configured to engage a receptacle defined in the baffle wall to hold the mask to the baffle.

9. The lighting system of claim 1 wherein the lighting system is configured to permit movement of air from the baffle wall lower end to the baffle wall upper end.

10. A mask configured to couple to a lighting baffle comprising a wall extending from an upper end to a lower end and a lip extending from the wall lower end to a lip outer edge and defining a lip face, the mask comprising:

an outer flange defining an outer edge and an inner end and having aesthetics different from aesthetics of the lip face;

an inner flange extending from the outer flange inner end; and at least one finger extending from the outer flange outer edge, the finger configured to extend along a height of the baffle lip outer edge to couple the mask to the baffle;

wherein the mask is configured to couple to the baffle and cover the lip face.

11. The mask of claim 10, wherein the at least one mask finger configured to engage the baffle lip outer edge and the mask inner flange configured to engage the baffle wall adjacent the wall lower end.

12. The mask of claim 10 wherein the inner flange is configured to create a force fit against the baffle to couple the mask to the baffle.

13. The mask of claim 10 further comprising one of a rib or a nub on the inner flange to couple the mask to the baffle.

14. A baffle kit comprising:

a lighting baffle having a wall extending from an upper end to a lower end and a lip extending from the wall lower end to a lip outer edge and defining a lip face, a first mask configured to couple to the baffle and cover the lip face, wherein the first mask provides aesthetics different from the aesthetics of the lip face, the first mask comprising:

an outer flange defining an outer edge and an inner end;

an inner flange extending from the outer flange inner end;

at least one finger extending from the outer flange outer edge, the finger configured to extend along a height of the baffle lip outer edge to couple the first mask to the baffle; and a second mask configured to couple to the baffle and cover the lip face, wherein the second mask provides aesthetics different from aesthetics of the lip face and the first mask.

15. The baffle kit of claim 14 wherein only portions of the first mask provide aesthetics different from the aesthetics of the lip face.

16. The baffle kit of claim 14 wherein the first mask further comprises an inner flange extending from the outer flange inner end; and only portions of the outer flange provide aesthetics different from the aesthetics of the lip face.

17. The baffle kit of claim 14 wherein the first mask further comprises an inner flange extending from the outer flange inner end.

18. The baffle kit of claim 14 wherein the first mask further comprises an inner flange extending from the outer flange inner end; and the inner flange is configured to create a force fit against the baffle.

19. The baffle kit of claim 14 wherein the baffle is configured to permit movement of air from the baffle wall lower end to the baffle wall upper end.

* * * * *